United States Patent [19]

Olsson et al.

[11] Patent Number: 5,063,850

[45] Date of Patent: Nov. 12, 1991

[54] METHOD AND SYSTEM FOR MINE SWEEPING

[75] Inventors: Thord Olsson, Bjärred; Tomas Öhrwall, Ängelholm; Mats Gustavsson, Landskrona, all of Sweden

[73] Assignee: SA Marine AB, Landskrona, Sweden

[21] Appl. No.: 473,987

[22] PCT Filed: Oct. 13, 1988

[86] PCT No.: PCT/SE88/00531

§ 371 Date: Jun. 19, 1990

§ 102(e) Date: Jun. 19, 1990

[87] PCT Pub. No.: WO89/03788

PCT Pub. Date: May 5, 1989

[30] Foreign Application Priority Data

Oct. 20, 1987 [SE] Sweden ..... 8704069

[51] Int. Cl.[5] ..... B63G 7/06

[52] U.S. Cl. ..... 102/402

[58] Field of Search ..... 102/402, 417

[56] References Cited

U.S. PATENT DOCUMENTS

| | | | |
|---|---|---|---|
| 2,397,209 | 3/1946 | Schaelchlin | 102/402 |
| 2,937,611 | 5/1960 | Schaelchliln et al. | 102/417 |
| 3,060,883 | 10/1962 | Herbst et al. | 102/406 |
| 3,707,913 | 1/1973 | Lee | 102/417 |
| 3,946,696 | 3/1976 | Lubnow | 102/401 |
| 4,627,891 | 12/1986 | Gibbard | 102/402 |
| 4,697,522 | 10/1987 | Groschupp et al. | 102/402 |

FOREIGN PATENT DOCUMENTS 205887 12/1986 European Pat. Off. .

*Primary Examiner*—Charles T. Jordan

*Attorney, Agent, or Firm*—Merchant & Gould Smith, Edell, Welter & Schmidt

[57] ABSTRACT

The invention relates to a method and a system for sweeping marine mines having a magnetic sensor. According to the method spaced electrodes (10, 11, 13) are towed by a vessel (12) and the electrodes (10, 11, 13) are supplied with electric current from the vessel (12) so as to set up a magnetic field in the water surrounding the electrodes. At least three electrodes are utilized in the sweeping, and each electrode is supplied with electric current individually, the strength of which can be controlled. The system comprises a power source arranged on the vessel so as to generate current for the electrodes. The power source allows individually supply and control of the current to each of the electrodes.

5 Claims, 3 Drawing Sheets

METHOD AND SYSTEM FOR MINE SWEEPING

Figure 1:
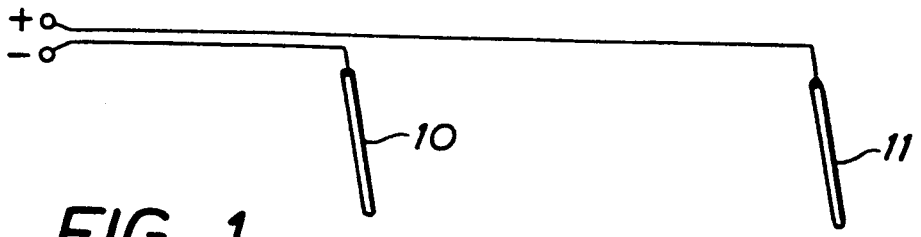

The present invention relates to a method for sweeping marine mines having a magnetic sensor, according to which spaced electrodes are towed by a vessel and said electrodes are supplied with electric current from the vessel to set up a magnetic field in the water, surrounding the electrodes with a magnetic field.

Sweeping for marine mines that are triggered by a magnetic sensor means requires that a magnetic field be set-up in the water which is strong enough to be sensed by the mine as a vessel target, causing the mine to be detonated. In order to protect the vessel carrying out the mine sweeping, it is desireable to limit the magnetic field to an area which is at a safe distance from the mine sweeping vessel. In practice, the mine sweeping arrangement is towed behind the mine sweeping vessel at a distance of approximately 200 to 600 meters.

A sweeping operation must fulfil two primary demands. The first demand is to make mines having a low sensitivity detonate even if they are displaced a large distance in the transverse direction of the track of the vessel. This is the so-called sweeping width preferably chosen to be of a size of the order of 100 to 500 m. The second demand is that mines having a high sensitivity shall not be initiated within a certain security zone surrounding the sweeping vessel. These demands are partially conflicting because a strong magnetic field required to satisfy said first demand makes difficult to satisfy said second demand.

The procedure of sweeping marine mines having a magnetic sensor by means of an electrode sweeping arrangement is as follows. Two or more electrodes are placed in the water and towed by one or more vessels. The electrodes are supplied with electric current through cables from the towing vessel, the current in the cables and through the water generating the desired magnetic field. In the so-called two electrode sweeping arrangement two rod-shaped electrodes made of some conducting material and associated feeding cables are utilized. This type of mine sweeping arrangement, the most simple one, has been improved in many ways according to prior art technique.

U.S. Pat. No. 2,937,611 discloses a system in sweeping marine mines by means of a plurality of vessels, each vessel towing two electrodes. The system provides a pulsating magnetic field between the several electrodes. U.S. Pat. No. 2,397,209 relates to a system in mine sweeping according to which a pulsating magnetic field is provided between two of the electrodes towed by the vessel. A more complicated system in mine sweeping is disclosed in U.S. Pat. No. 3,946,696. The system comprises two electrodes, a controlled current generator, and a magnetic field sensor. There is also included a control system controlling the current through the electrodes in dependence on the magnetic field in the vicinity of the mine sweeping vessel. By measuring the magnetic field adjacent to the mine sweeping vessel the desired safety of the mine sweeping vessel can be achieved.

Another simple contructive step to improve the protection of the mine sweeping vessel without imparing the desired mine sweeping properties is to extend the mine sweeping arrangement behind the vessel. However, practical problems in handling long cables limit the length of the mine sweeping arrangements.

A device in sweeping mines actuatued both acoustically and magnetically is described in EP A1 0 205 887.

An object of the present invention is to provide a method for sweeping marine mines initiated magnetically, which meets the demand of a safe detonation of mines, even if the mines are displaced a distance in the transverse direction of the track of the vessel, as well as the demand of a satisfactory safety of the mine sweeping vessel. This is accomplished by imparting to the generated magnetic field a desired propagation characteristic with a sufficiently weak magnetic field adjacent to the mine sweeping vessel.

Figure 2:
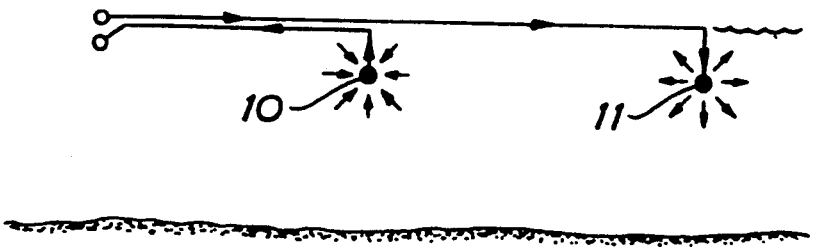
Figure 3:
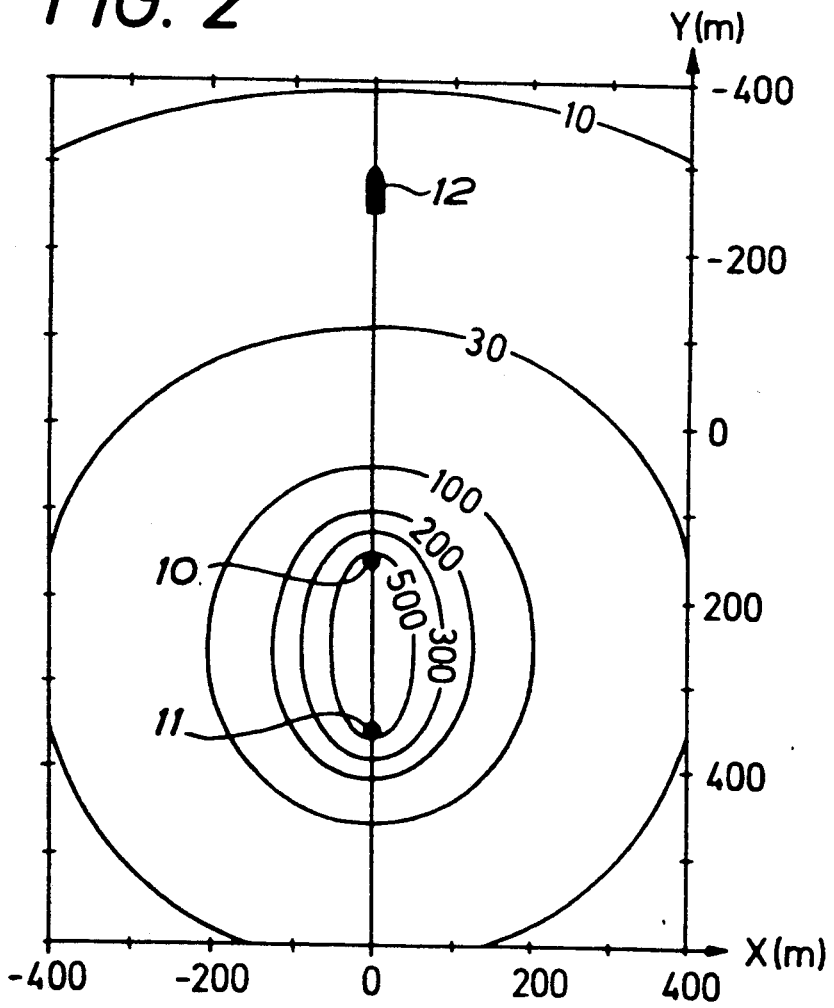
Figure 4:
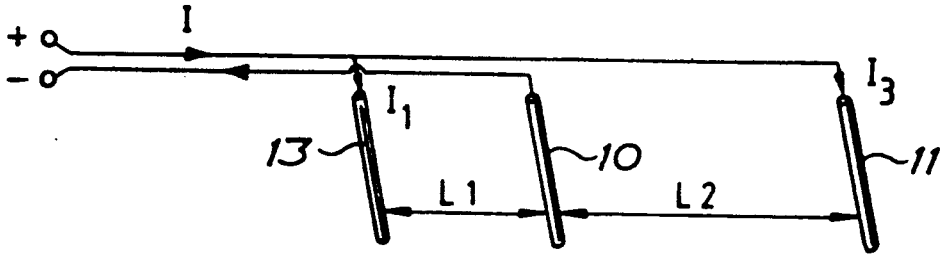
Figure 5:
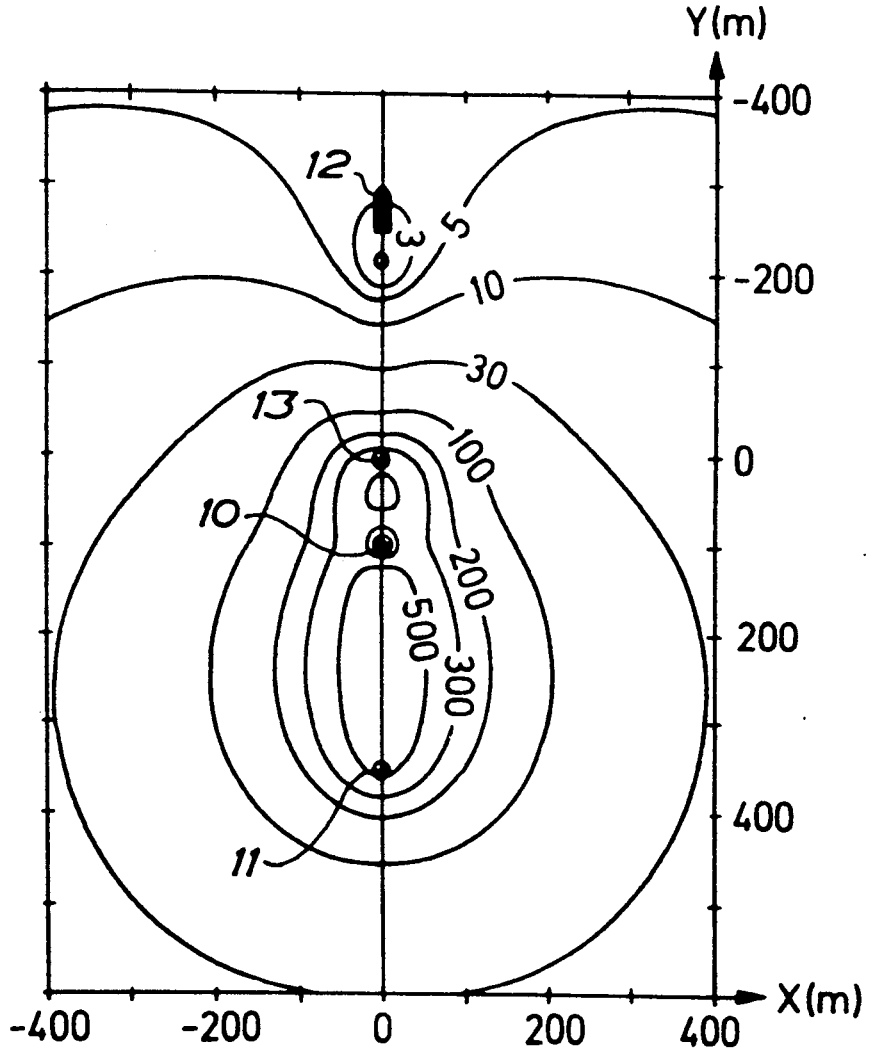

The invention will be explained in more detail by means of embodiments, reference being made to the accompanying drawings, in which FIG. 1 is a diagrammatic view of a prior art two-electrode sweeping arrangement, FIG. 2 shows a model to be applied in calculating the field propagation from a two-electrode sweeping arrangement according to FIG. 1, FIG. 3 is a graph showing the field propagation of a two-electrode sweeping arrangement according to FIG. 1, FIG. 4 is a diagrammatic view of a prior art three-electrode sweeping arrangement, FIG. 5 is a graph showing the field propagation of the three-electrode sweeping arrangement according to FIG. 4.

Figure 6:
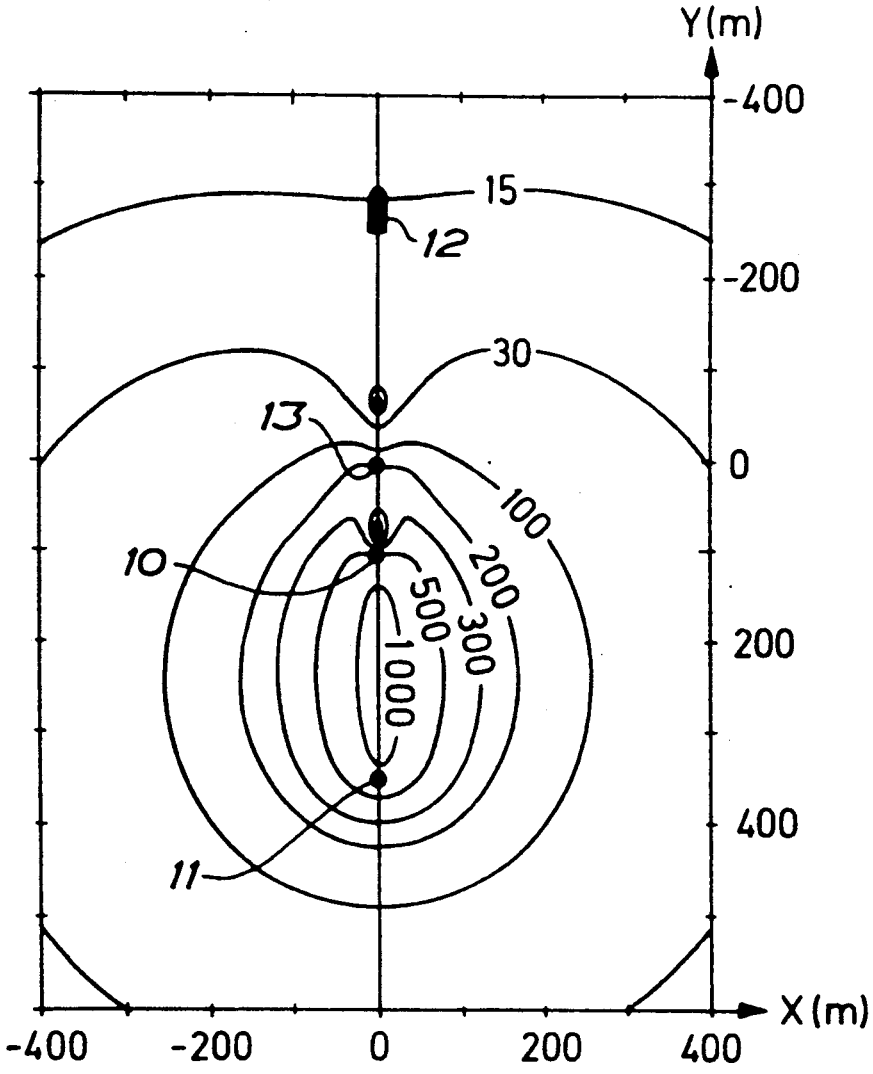
Figure 7:
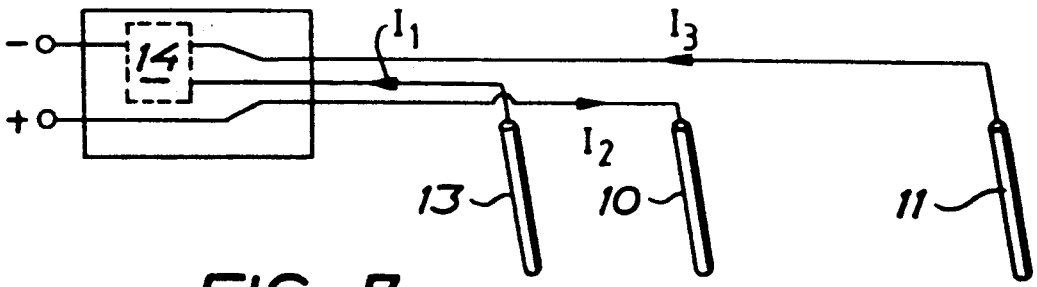

FIG. 6 is a graph showing the field propagation from the three-electrode sweeping arrangement according to FIG. 4, the ambient conditions being changed, and FIG. 7 is a diagrammatic view of a three-electrode sweeping arrangement according to the present invention.

The two-electrode sweeping arrangement according to FIG. 1 comprises a first electrode 10 which is towed next to the vessel during the sweeping operation, and a second farther electrode 11. Current is supplied to the electrodes from a generator, direct current being supplied by a rectifier aboard the ship. By approximating the rod shaped electrodes with point shaped electrodes a model is provided by means of which the magnetic field set up by the electric current between the electrodes can be calculated with high accuracy, at least at a distance from the sweeping arrangment. FIG. 2 shows this model.

The propagation characteristic of the magnetic field set up by the electrode configuration according to FIG. 1 is shown in the graph of FIG. 3. The magnetic field shown in the graph is set up on one hand by the current through the conductor leading to electrode 10 and 11, respectively, and on the other hand by the current through the water between the electrodes. The graph of FIG. 3 shows the magnetic field from a fictitious electrode sweeping arrangement having two electrodes arranged at a spacing of 20 m and fed by 200 A. The magnetic field is expressed by the absolute value of the magnetic flux density in nT.

A development of the two-electrode sweeping arrangement is shown in FIG. 4. A third electrode 13 is inserted between the forward electrode 10 and the vessel. The graph of FIG. 5 shows the propagation of the magnetic field set up by the three electrodes when current is supplied to said three electrodes according to FIG. 4. The front electrode 13 suppresses the propagation of the field in the forward direction towards the mine sweeping vessel and thus maintains a high level of protection of the vessel. In the example $I1 = I3 = 200$ A, the distance L1 between the two front electrodes is 100 m, and the distance L2 between the rear electrode 11 and the centre electrode 10 is 250 m. The total length of the sweeping arrangement of FIG. 5 is approximately 600 m, which is equal to the total length of the sweeping arrangement of FIG. 3.

As mentioned initially two partly conflicting demands must be satisfied in mine sweeping. The sweeping width should be at maximum, resulting in the magnetic field being strong enough to activate mines in an area as large as possible. In the examples of FIG. 3 and FIG. 5, respectively, the area covered by a magnetic field of the strength 100 nT, has a width of slightly over 400 m. 100 nT will be sensed by most mines as a vessel target, and thus the first demand can be said to be satisfied in an adequate way. The second demand is the safety zone of the mine sweeping vessel. The flux density allowed in the vicinity of the mine sweeping vessel varies depending on different factors, but if 5 nT is the maximum tolerated strength below and ahead of the vessel it is clear from FIGS. 3 and 5 that it is only the three-electrode sweeping arrangement according to FIG. 5 that fulfils this second demand.

A crucial factor of the field propagation characteristic of a three-electrode sweeping arrangement is the relationship between the current I1 in the front electrode 13 and the current I3 in the rear electrode 11 and the spacing between the electrodes 10, 11 and 13. In FIG. 5, L1 is 100 m and L2 is 350 m (see also FIG. 4). The relationship between I1 and I3 is 1, i.e. the currents I1 and I3 are of the same size and have the same direction. FIG. 6 shows the changed propagation characteristic of the magnetic field when the relationship between the currents I1 and I3 is instead 0.5, the electrode spacing being unchaged. It is apparent from FIG. 6 that the demand of a safety zone of the mine sweeping vessel is not fulfiled. The changed relationship between the currents I1 and I3 may be the result of changes of the conductivity of the water. Since the conductivity is varying within broad limits, no adequate safety will be obtained by this type of three-electrode sweeping arrangement as far as the magnetic field propagation in the vicinity of the mine sweeping vessel is concerned.

According to the present invention the desired safety of the mine sweeping vessel is indeed obtained, while at the same time the propagation of the magnetic field in the transverse direction can be controlled as desired. This is accomplished by means of a three-electrode sweeping arrangement according to FIG. 7, all three electrodes being towed in line by a mine sweeping vessel, by supplying the current to each electrode of the electrode sweeping arrangement separately and by controlling individually the current for each electrode. To provide a magnetic sweeping arrangement according to the present invention the electrodes first of all are arranged in a suitable manner as to the types of electrodes, types of cables, and the spacing between the electrodes. Starting with these fundamentals the desired relationship between the currents I1 to the front electrode 13 and the current I3 to the rear electrode 11 is determined. The currents I1, I2 and I3 are then adjusted to suitable values so as to achieve the desired current relationship. Then, the mine sweeping can start and continue over areas having a highly varying water conductivity, the safety of the mine sweeping vessel being maintained. Thus, the relationship between the current I1 to the front electrode 13 and the current I3 to the rear electrode 11 is maintained at the preset value by the current to each electrode being positively controlled.

The method according to the invention also allows an adjustment of other propagation characteristics selected in accordance with the actual situation. Thus, mine sweeping of extremely non-sensitive mines and sweeping arrangement having a considerably larger sweeping width are easily provided. It is also possible to make the sweeping arrangement function as a two-electrode sweeping arrangement by completely cutting off the current for one of the electrodes.

To achieve currents which can be individually controlled to all of the electrodes a device according to FIG. 7 can be utilized. The device comprises a current generator, not shown, and a control and regulator device 14 for controlling separately the currents I1 and I3. In another embodiment, not shown, the device comprises an AC-generator and a controlled thyristor rectifier for each of the outer electrodes 11, 13.

The electrodes and the cable of conventional construction.

We claim:

1. Method for sweeping marine mines having a magnetic sensor, according to which spaced electrodes (10, 11, 13) are towed by a vessel (12), and said electrodes (10, 11, 13) are supplied with electric current from the vessel (12) to set up a magnetic field in the water surrounding said electrodes (10, 11, 13) characterised in that at least three electrodes (10, 11, 13) are utilized and that each electrode (10, 11, 13) separately is supplied with electric current, the strength of the current being individually controllable while maintaining a predetermined relationship between the current supplied to the electrode (13) arranged most closely to the vessel and the current supplied to the electrode (11) arranged most distant of the vessel.

2. Method according to claim 1, characterized in that a first (13), a second (10) and a third (11) electrode are arranged in a row behind the vessel (12), the row being essentially along a straight line with said first electrode (13) next to the vessel (12), and that depending on the size of the electrodes and the spacing thereof the current (11) to the first electrode (13) and the current (13) to the third electrode (11) are controlled to establish a predetermined mutual relationship, and the current (12) to the second centre electrode (10) is controlled to a value that generates a desired propagation characteristic of the magnetic field generated between the electrodes (10, 11, 13).

3. System for sweeping marine mines having a magnetic sensor, comprising a vessel (12), a plurality of electrodes (10, 11, 13) connected to said vessel to be towed behind said vessel, and a power source arranged on said vessel for generating current to said electrodes (10, 11, 13), wherein said power source allows supply and control of the current individually to each of said electrodes (10, 11, 13), said power source comprising an AC-generator and at least a first and second controlled current rectifier, each of which being provided with two output terminals, one of the output terminals of said first current rectifier is connected to a first electrode (13) arranged next to said vessel (12), the second output terminal of said first current rectifier is connected to the first output terminal of said second current rectifier, said output terminal in turn being connected to a second electrode (10) arranged behind said first electrode (13), and the second output terminal of said second current rectifier is connected to a third electrode (11), arranged behind said second electrode (10).

4. System for sweeping marine mines having a magnetic sensor, comprising a vessel (12), a plurality of electrodes (10, 11, 13) connected to the vessel to be towed behind the vessel, and a power source arranged on the vessel for generating current to the electrodes (10, 11, 13), wherein said power source allows supply and control of the current individually to each of said electrodes (10, 11, 13), said power source comprising a transformer connected to an existing generator on the mine sweeping vessel, and at least one first and one second controlled current rectifier, each of which is provided with two output terminals such that one output terminal of said first current rectifier is connected to a first electrode (13) arranged next to the vessel (12), the second output terminal of said first current rectifier is connected to the first output terminal of said second current rectifier, said first output terminal in turn being connected to a second electrode (10) arranged behind said first electrode (13), and the second output terminal of said second current rectifier is connected to a third electrode (11) arranged behind said second electrode (10).

5. System for sweeping marine mines having a magnetic sensor, comprising a vessel (12), a plurality of electrodes (10, 11, 13) connected to the vessel to be towed behind the vessel, and a power source arranged on the vessel for generating current to the electrodes (10, 11, 13), wherein said power source allows supply and control of the current individually to each of the electrodes (10, 11, 13), said power source comprising at least two DC-generators, each of which being provided with two output terminals, one output terminal of said first DC-generator is connected to a first electrode (13) arranged next to the vessel (12), the second output terminal of said first DC-generator is connected to the first output terminal of said second DC-generator, said first output terminal in turn being connected to a second electrode (10) arranged behind said first electrode (13), and the second output terminal of said second DC-generator is connected to a third electrode (11) arranged behind said second electrode (10).

* * * * *